US008424157B2

(12) United States Patent
Gell et al.

(10) Patent No.: US 8,424,157 B2
(45) Date of Patent: Apr. 23, 2013

(54) TOOL FOR A SURFACE TREATING APPLIANCE

(75) Inventors: Ian Gell, Malmesbury (GB); Jean-Paul Mark Iles, Malmesbury (GB); Giles Ashbee, Malmesbury (GB); Thomas James Dunning Follows, Malmesbury (GB); Stephen Benjamin Courtney, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 398 days.

(21) Appl. No.: 12/813,264

(22) Filed: Jun. 10, 2010

(65) Prior Publication Data

US 2010/0319159 A1 Dec. 23, 2010

(30) Foreign Application Priority Data

Jun. 17, 2009 (GB) ..... 0910454.8
Jun. 17, 2009 (GB) ..... 0910456.3

(51) Int. Cl.
*A47L 9/02* (2006.01)

(52) U.S. Cl.
USPC ..... 15/415.1; 15/400; 15/402; 15/420

(58) Field of Classification Search ..... 15/400, 15/402, 414, 415.1, 420
See application file for complete search history.

(56) References Cited

U.S. PATENT DOCUMENTS 2,703,903 A 3/1955 Faith-ell
3,497,903 A 3/1970 Jonsson
3,599,271 A 8/1971 Ljung et al.
3,659,312 A 5/1972 Mattsson
3,660,864 A 5/1972 Schwartz
3,768,114 A 10/1973 Schwartz
3,798,704 A 3/1974 Kilstrom et al.

(Continued)

FOREIGN PATENT DOCUMENTS

CN 1187980 7/1998
DE 26 02 969 7/1977

(Continued)

OTHER PUBLICATIONS

International Search Report and Written Opinion mailed Nov. 2, 2010, directed to counterpart application No. PCT/GB2010/050864; 16 pages.

(Continued)

*Primary Examiner* — William Gilbert
*Assistant Examiner* — Patrick Maestri
(74) *Attorney, Agent, or Firm* — Morrison & Foerster LLP

(57) ABSTRACT

A tool for a surface treating appliance includes a main body connected to a conduit. The main body includes a first suction channel and a second suction channel in fluid communication with the first suction channel and located between the first suction channel and an outlet from the main body. In use, a relatively low vacuum is generated in the first suction channel which draws a first dirt-bearing fluid flow into the main body, and a relatively high vacuum is generated in the second suction channel, which draws a second dirt-bearing fluid flow into the main body and receives the first dirt-bearing fluid flow from the first suction channel. To maintain the pressure differences between the suction channels, the main body includes flexible surface engaging members located about the suction channels, and between the first suction channel and the second suction channel.

21 Claims, 9 Drawing Sheets

U.S. PATENT DOCUMENTS

| | | | | |
|---|---|---|---|---|
| 4,014,068 | A | 3/1977 | Payne et al. | |
| 4,180,887 | A | 1/1980 | Wudel et al. | |
| 4,336,628 | A | 6/1982 | Bradshaw et al. | |
| 4,447,931 | A | 5/1984 | Lindqvist | |
| 4,564,972 | A | 1/1986 | Varin | |
| 4,638,526 | A | 1/1987 | Murata et al. | |
| 4,888,852 | A | 12/1989 | Varin | |
| 5,123,141 | A * | 6/1992 | Erickson et al. | 15/373 |
| 5,539,953 | A | 7/1996 | Kurz | |
| 5,553,349 | A | 9/1996 | Kilstrom et al. | |
| 5,564,161 | A | 10/1996 | Glatz | |
| 6,009,594 | A | 1/2000 | Grey | |
| 7,069,620 | B2 * | 7/2006 | Bagwell | 15/398 |
| 7,278,181 | B2 | 10/2007 | Harris et al. | |
| 7,467,439 | B2 | 12/2008 | Lijzenga et al. | |
| 7,540,064 | B2 | 6/2009 | Cho et al. | |
| 7,584,522 | B1 | 9/2009 | Weeter et al. | |
| 2003/0163889 | A1 | 9/2003 | Bagwell | |
| 2005/0120512 | A1 | 6/2005 | Choi | |
| 2006/0213026 | A1 | 9/2006 | Lijzenga et al. | |
| 2010/0229339 | A1 | 9/2010 | Lambourn | |
| 2011/0010886 | A1 | 1/2011 | Arthey et al. | |
| 2011/0010889 | A1 | 1/2011 | Arthey et al. | |
| 2011/0010890 | A1 | 1/2011 | Dimbylow et al. | |

FOREIGN PATENT DOCUMENTS

| | | |
|---|---|---|
| DE | 31 31 380 | 2/1983 |
| DE | 36 02 926 | 8/1987 |
| DE | 199 33 449 | 11/2000 |
| DE | 203 12 836 | 1/2004 |
| EP | 1 092 380 | 4/2001 |
| EP | 1 320 317 | 6/2003 |
| EP | 1 875 846 | 1/2008 |
| EP | 2 027 805 | 2/2009 |
| FR | 1545346 | 11/1968 |
| FR | 2 696 633 | 4/1994 |
| FR | 2 773 317 | 7/1999 |
| FR | 2 792 817 | 11/2000 |
| FR | 2 871 046 | 12/2005 |
| GB | 851185 | 10/1960 |
| GB | 1077574 | 8/1967 |
| GB | 1190219 | 4/1970 |
| GB | 1 289 381 | 9/1972 |
| GB | 1 289 468 | 9/1972 |
| GB | 1 315 024 | 4/1973 |
| GB | 1 328 944 | 9/1973 |
| GB | 1 493 097 | 11/1977 |
| GB | 1 505 783 | 3/1978 |
| GB | 2 381 443 | 5/2003 |
| JP | 48-22430 | 7/1973 |
| JP | 49-1105 | 1/1974 |
| JP | 52-91558 | 8/1977 |
| JP | 54-6359 | 1/1979 |
| JP | 56-9348 | 1/1981 |
| JP | 57-58352 | 4/1982 |
| JP | 58-46553 | 3/1983 |
| JP | 62-184847 | 11/1987 |
| JP | 64-83229 | 3/1989 |
| JP | 4-132530 | 5/1992 |
| JP | 5-261041 | 10/1993 |
| JP | 10-323303 | 12/1998 |
| JP | 11-56710 | 3/1999 |
| JP | 11-276392 | 10/1999 |
| JP | 2004-167268 | 6/2004 |
| JP | 2006-525845 | 11/2006 |
| JP | 2007-54145 | 3/2007 |
| JP | 2008-86550 | 4/2008 |
| JP | 2009-45440 | 3/2009 |
| KR | 10-2004-0105163 | 12/2004 |
| KR | 10-0895129 | 1/2009 |
| WO | WO-99/34721 | 7/1999 |
| WO | WO-02/26097 | 4/2002 |
| WO | WO-02/085174 | 10/2002 |
| WO | WO-2004/105569 | 12/2004 |
| WO | WO-2005/074778 | 8/2005 |
| WO | WO-2005/087072 | 9/2005 |

OTHER PUBLICATIONS

GB Search Report dated Sep. 29, 2009, directed to corresponding GB Patent Application No. 0910454.8; 1 page.

GB Search Report dated Sep. 29, 2009, directed to corresponding GB Patent Application No. 0910456.3; 1 page.

Lambourn, Office Action mailed Jun. 6, 2012, directed to U.S. Appl. No. 12/722,145; 6 pages.

Dimbylow et al., U.S. Office Action mailed Aug. 16, 2012, directed to U.S. Appl. No. 12/831,841; 12 pages.

Arthey et al., U.S. Office Action mailed Sep. 10, 2012, directed to U.S. Appl. No. 12/831,056; 13 pages.

Arthey et al., U.S. Office Action mailed Nov. 19, 2012, directed to U.S. Appl. No. 12/830,968; 16 pages.

Lambourn, U.S. Office Action mailed Jan. 31, 2013, directed to U.S. Appl. No. 12/722,145; 6 pages.

* cited by examiner

W - W

X - X

TOOL FOR A SURFACE TREATING APPLIANCE

REFERENCE TO RELATED APPLICATIONS

This application claims the priority of United Kingdom Application Nos. 0910454.8 and 0910456.3, filed Jun. 17, 2009, the entire contents of which are incorporated herein by reference.

FIELD OF THE INVENTION

The present invention relates to a tool for a surface treating appliance. In its preferred embodiment, the present invention relates to a floor tool for a vacuum cleaning appliance.

BACKGROUND OF THE INVENTION

Vacuum cleaners are generally supplied with a range of tools for dealing with specific types of cleaning. The tools include a floor tool for general on-the-floor cleaning. The floor tool comprises a main body which engages with a floor surface. The main body has a lower surface comprising a suction opening through which, in use, dirt and dust is drawn into the floor tool from the floor surface.

It is known to provide floor tools for cleaning hard floor surfaces with a skirt of flexible bristles which surrounds the suction opening and which rides along the hard floor surface to space the lower surface of the main body from the floor surface. Recesses or castellations may be provided along the leading and trailing edges of the bristle skirt to allow debris to pass through the bristle skirt and into the main body during forward and reverse strokes of the floor tool during cleaning.

It is also known to provide floor tools having dual cleaning purposes. For example, EP 1 320 317 discloses a floor tool having a suction channel bounded on at least one side by a working edge for engaging with and agitating a carpeted floor surface. Lint pickers on the underside of the tool act as a one-way gate, allowing hair, fluff and other fibrous material to pass under the lint picker when the floor tool is pushed along the floor, but to block the lint when the floor tool is pulled backwards. The repeated forward and backwards action of the floor tool across the floor surface traps the lint and rolls it into a ball which can be captured by the floor tool. The floor tool also comprises a skirt of flexible bristles which surrounds, but is not part of, the underside of the floor tool. The skirt is movable between a deployed position, for use when cleaning hard floors, in which the skirt rides along the hard floor surface and serves to space the working edge from the floor surface, and a retracted position, for use when cleaning carpets, where the working edge is able to contact the floor surface and the skirt is retracted sufficiently not to impede movement of the floor tool across the carpeted surface.

As another example, DE 19933449 describes a floor tool in which the main body is fitted with a bristle skirt and surface polishing elements having a textile polishing surface. A longer polishing element lies in the suction direction behind the suction opening, with two shorter polishing elements being located on either side of the suction opening. The bristle skirt is moveable relative to the main body between deployed and retracted positions. The movement of the bristle skirt is actuated by a user of the floor tool using a switch located on the upper surface of the main body. In its deployed position, for use in removing debris from a hard floor surface, the bristle skirt protrudes downwardly beyond the polishing elements so that the polishing elements are spaced from the floor surface. In its retracted position, for use in polishing the hard floor surface, the bristle skirt is retracted above the polishing elements to enable the polishing elements to engage the floor surface.

SUMMARY OF THE INVENTION

In a first aspect the present invention provides a tool for a surface treating appliance comprising a main body connected to a conduit, the main body comprising a first suction channel for receiving a first dirt-bearing fluid flow and a second suction channel for receiving the first dirt-bearing fluid flow from the first suction channel and a second dirt-bearing fluid flow, and for conveying the dirt-bearing fluid flows to the conduit, wherein the first suction channel and the second suction channel are at least partially defined by flexible surface engaging members, the flexible surface engaging members comprising at least one first flexible surface engaging members located about the suction channels and at least one second flexible surface engaging members located between the suction channels.

This "division" of the main body into two interconnected suction channels by the flexible surface engaging members can enable two different pressure regions to be established within the main body. A relatively high vacuum may be established in the second suction channel which optimizes the performance of the tool for capturing dirt and dust located within crevices in a floor surface. Simultaneously, a relatively low vacuum may be established in the first suction channel, which can improve the performance of the tool for capturing debris located on the surface without significantly impairing the capture of dirt and dust within crevices. Therefore, in a second aspect the present invention provides a tool for a surface treating appliance, comprising a main body connected to a conduit, the main body comprising flexible means, such as at least one flexible surface engaging member, for defining within the main body a first suction channel for receiving a first dirt-bearing fluid flow, and a second suction channel, connected to the first suction channel, for receiving the first dirt-bearing fluid flow from the first suction channel and, separately from the first dirt-bearing fluid flow, a second dirt-bearing fluid flow, and for conveying the dirt-bearing fluid flows to the conduit, wherein, in use, a relatively low vacuum is established in the first suction channel and a relatively high vacuum is established in the second suction channel.

Flexible surface, or floor, engaging members located about the suction channels and between the suction channels maintain the pressure levels within the suction channels as the tool is maneuvered over a surface.

The second suction channel is preferably located between an outlet of the main body and the first suction channel, and is preferably located adjacent the outlet from the main body.

The first suction channel is preferably located towards the front of the main body, whereas the second suction channel is preferably located towards the rear of the main body. The second suction channel preferably comprises an enlarged central portion extending rearwardly away from the first suction channel to enhance stability as the tool is maneuvered in a return stroke over the surface.

Preferably, the tool comprises first flexible surface engaging members, preferably one or more of a plurality of bristles, a plurality of filaments and at least one strip of flexible material, located about the suction channels, and second flexible surface engaging members, preferably also one or more of a plurality of bristles, a plurality of filaments and at least one strip of flexible material, located between the first suction channel and the second suction channel. A series of relatively large castellations may be provided in a portion of the first surface engaging members adjacent the first suction channel to admit relatively large debris into the first suction channel during, for example, a forward stroke of the tool. A series of relatively small castellations may be provided in a portion of the first surface engaging members adjacent the second suction channel to admit relatively small debris into the second suction channel during, for example, a reverse stroke of the tool.

Dirt and debris may thus enter the second suction channel within three different fluid flows. A first dirt-bearing fluid flow enters the second suction channel from the first suction channel to convey relatively large surface-located debris into the second suction channel. A second dirt-bearing fluid flow enters the second suction channel through the relatively small castellations to convey relatively small surface-located debris into the second suction channel. A third dirt-bearing fluid flow enters the second suction channel between the first and second flexible surface engaging members to convey crevice-located dirt and debris into the second suction channel. The first and second dirt-bearing fluid flows may enter the second suction channel in substantially opposite directions, whereas the third dirt-bearing fluid flow may enter the second suction channel in a direction substantially orthogonal to one or both of the first and second dirt-bearing fluid flows.

The tool preferably comprises at least one intermediate channel located between the first suction channel and the second suction channel for conveying a fluid flow therebetween. The at least one intermediate channel is preferably co-planar with the suction channels, and may extend transversely to the suction channels. In the preferred embodiment the main body comprises a first intermediate channel and a second intermediate channel located at or towards opposite sides of the main body. The intermediate channels may be defined by interruptions in the second surface engaging members, or by spaces between the first and second surface engaging members. Alternatively, or additionally, at least one intermediate channel may be formed in a housing of the main body which at least partially defines the suction channels.

Preferably, the conduit comprises a head comprising at least one port for receiving the first and second dirt-bearing fluid flows from the second suction channel. The at least one port preferably comprises a first port and a second port located opposite to the first port each for receiving fluid from a respective side of the second suction channel. The ports may be conveniently located on opposite sides of the head to facilitate sealing between the conduit and the main body. The head is preferably pivotable relative to the main body about an axis which passes through.

To facilitate sealing between the main body and the conduit, each port is preferably substantially circular, and the ports are preferably concentric. In a preferred embodiment the head is substantially cylindrical, with the first and second ports being located at opposing ends of the cylindrical head. The head has a longitudinal axis to which the first and second ports are preferably substantially orthogonal.

To provide a compact tool, the head comprises an outer surface which is preferably substantially flush with an adjoining portion of the main body. The adjoining portion of the main body preferably comprises an upper section of the main body, with this upper section being located towards the rear of the main body. Where the head of the conduit has a substantially cylindrical outer surface, the upper section of the main body preferably has a substantially semi-cylindrical portion adjoining each end of the head of the conduit, with the radius of the semi-cylindrical portion being substantially equal to the radius of the head of the conduit.

The main body preferably comprises means for supporting the head of the conduit above part of the second suction cavity. The means for supporting the head preferably comprises a support surface. Where the head is cylindrical in shape, the support surface preferably has a radius of curvature which is substantially the same as that of the head.

The conduit preferably comprises a neck connected to the head, preferably substantially midway between the ports. The neck preferably extends away from the head in a direction which is substantially orthogonal to the longitudinal axis of the head.

To reduce turbulence within the head, the head preferably comprises means for directing fluid towards the neck. Therefore, in a third aspect the present invention provides a tool for a surface treating appliance, comprising a main body connected to a conduit, the conduit comprising a head pivotably connected to the main body for movement relative thereto, and a neck connected to the head, the head comprising a first port and a second port each for conveying fluid into the conduit from the main body, and means for directing the fluid entering the head through each port towards the neck. The means for directing fluid towards the neck preferably comprises a plurality of guide surfaces located within the head and each for directing fluid entering the head through a respective port towards the neck. The guide surfaces are preferably integral with the inner wall of the head, with each guide surface preferably curving away from the inner wall of the head towards the neck.

To enable the main body to be widely maneuverable over a surface, the conduit preferably comprises a front section and a rear section. The front section is pivotably connected to the main body for movement about a first axis to allow the rear section of the conduit to be raised and lowered relative to the main body, which allows the main body to be maneuvered easily beneath furniture, and into gaps between furniture and walls, for example, as required. The range of articulation of the sections of the conduit about the first and second axes preferably enables the main body to be oriented both substantially perpendicular to a wand used to maneuver the tool over a floor surface, and substantially parallel to the wand.

The front section of the conduit is pivotable relative to the main body between a lowered position and a raised position about an angle which is preferably at least 60°, more preferably of at least 80°. In a preferred embodiment, the front section of the conduit is pivotable relative to the main body about an angle in the range from 90 to 180° as the front section of the conduit moves from a fully lowered position. A stop member may be provided on one of the conduit and the main body to restrict the angular movement of the conduit relative to the main body beyond its lowered position through contact between the stop member and the other one of the conduit and the main body.

The rear section is pivotably connected to the front section for movement relative thereto about a second axis which is spaced from the first axis. This allows the rear section to be angled relative to the front section to assist in the pushing, or pulling, of the main body over a surface, such as a floor surface, in a variety of orientations of the main body relative to, for example, a wand connected to the rear section of the conduit. The pivoting connection between the front section and the rear section enables the rear section to be connected to the front section so that it is located at least partially beneath the front section. This can allow the tool to have a low profile when the front section of the conduit is in its lowered position.

The rear section of the conduit is pivotable relative to the front section of the conduit about an angle which is preferably at least 120°, more preferably at least 150°. Stop members may again be provided, this time on one of the front section and the rear section, to limit the angular movement of the rear section relative to the front section through contact between the stop members and the other one of the front section and the rear section.

The rear section of the conduit preferably comprises a substantially circular fluid inlet which is rotatably connected to a conformingly shaped fluid outlet of the front section of the conduit so that the second axis passes centrally through, and is substantially orthogonal to, the fluid inlet of the rear section and the fluid outlet of the front section. The front section is preferably shaped so that the fluid outlet thereof is angled towards the main body when the front section is in its lowered position. The fluid outlet is preferably inclined at an angle in the range from 20 to 30° to the horizontal when the tool is located on a surface. The fluid inlet of the rear section is preferably inclined relative to the longitudinal axis of the rear section of the conduit so that the second axis is inclined to the longitudinal axis of the rear section by an angle in the range from 110 to 120°. The rear section may thus be shaped so that it can be aligned relative to the front section so that the longitudinal axis of the rear section is substantially horizontal when the front section is in its lowered position, and substantially vertical when the front section is in its raised position. Preferably, this alignment occurs when the longitudinal axis of the front section is parallel to the longitudinal axis of the rear section. Consequently, when the front section of the conduit is in its lowered position the rear section of the conduit may be aligned so that its longitudinal axis is both substantially horizontal and orthogonal to the main body of the tool, thereby facilitating the maneuvering of the tool beneath items of furniture or into other height-restricted spaces. When the front section of the conduit is in its raised position the rear section of the conduit may be aligned so that its longitudinal axis is both substantially vertical and orthogonal to the main body of the tool, thereby facilitating the maneuvering of the tool between items of furniture or into other narrow spaces.

The front section comprises the at least one port though which fluid is conveyed into the conduit from the main body. The first axis preferably passes through, more preferably through the centre of, the at least one port. This can enable a relatively simple seal to be provided between the main body and the conduit to inhibit fluid loss from therebetween to the external environment regardless of the position of the conduit relative to the main body, and allow the tool to have a low profile when the front section of the conduit is in its lowered position.

The tool may be in the form of a floor tool for removing dirt and debris from a floor surface, but the tool may be sized or scaled for one of a variety of purposes, for example for removing dirt or debris from a mattress, car or other raised surface.

In summary, a tool for a surface treating appliance comprises a main body connected to a conduit. The main body comprises a first suction channel and a second suction channel in fluid communication with the first suction channel and located between the first suction channel and an outlet from the main body. In use, a relatively low vacuum is generated in the first suction channel which draws a first dirt-bearing fluid flow into the main body, and a relatively high vacuum is generated in the second suction channel, which draws a second dirt-bearing fluid flow into the main body separately from the first dirt-bearing fluid flow, and also receives the first dirt-bearing fluid flow from the first suction channel. To maintain the pressure differences between the suction channels, the suction channels are defined by flexible surface engaging members located about the suction channels, and between the first suction channel and the second suction channel.

Features described above in connection with the first aspect of the invention are equally applicable to either of second and third aspects of the invention, and vice versa. The term fluid, used herein, may include air.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
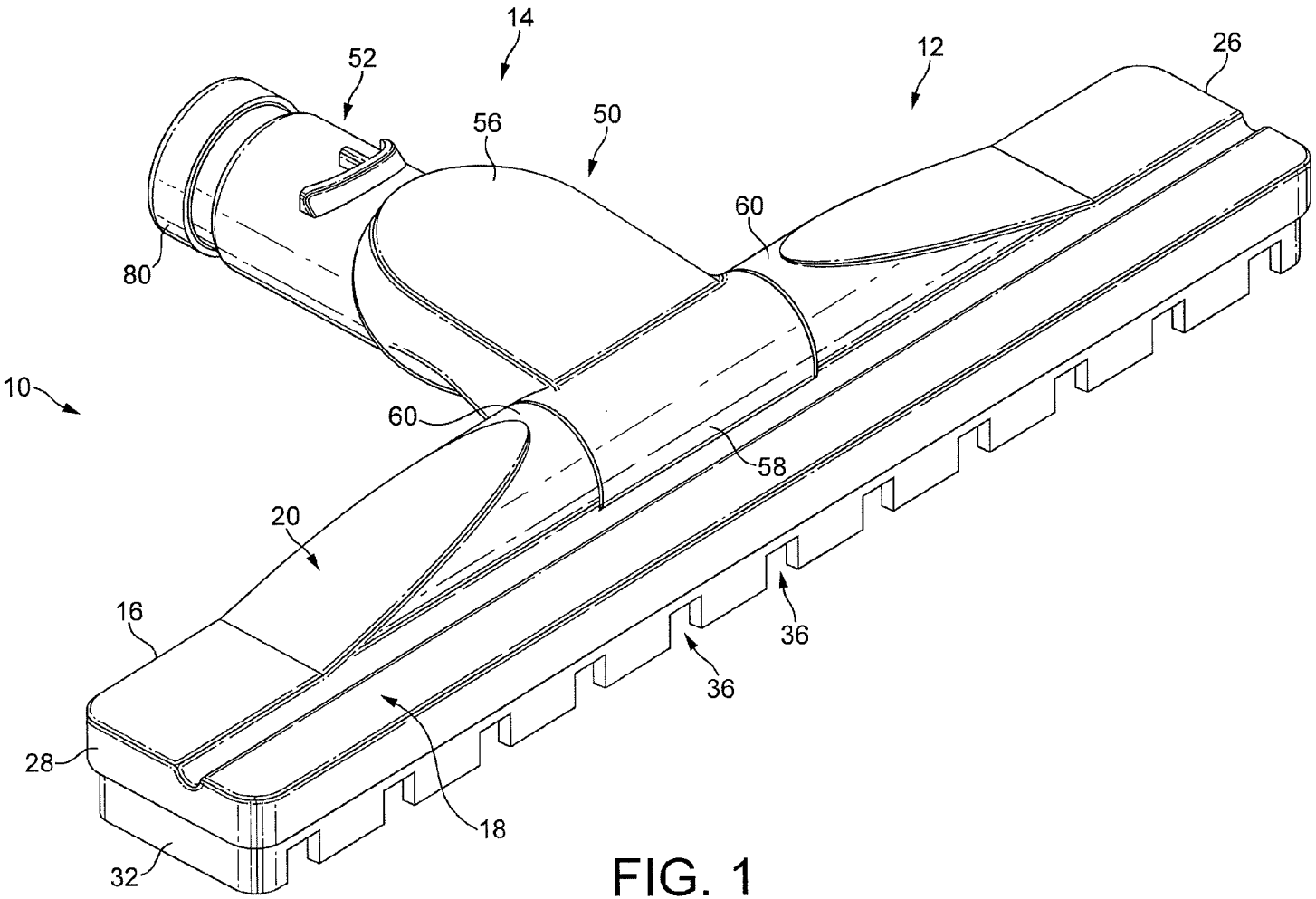
FIG. 1 is a front perspective view of a floor tool, with a conduit of the floor tool in a lowered position.
Figure 2:
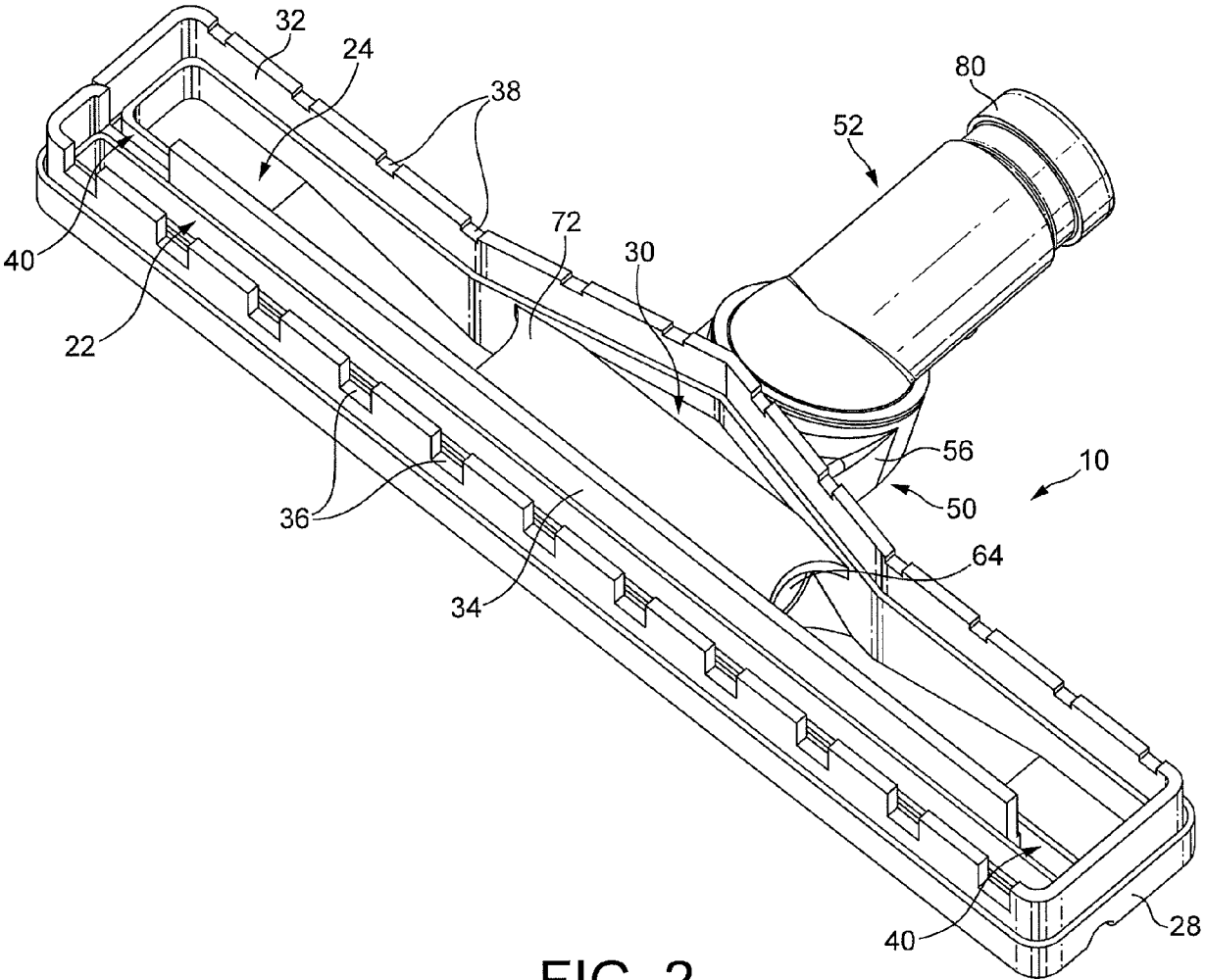
FIG. 2 is a bottom perspective view of the floor tool as positioned in FIG. 1.
Figure 3:
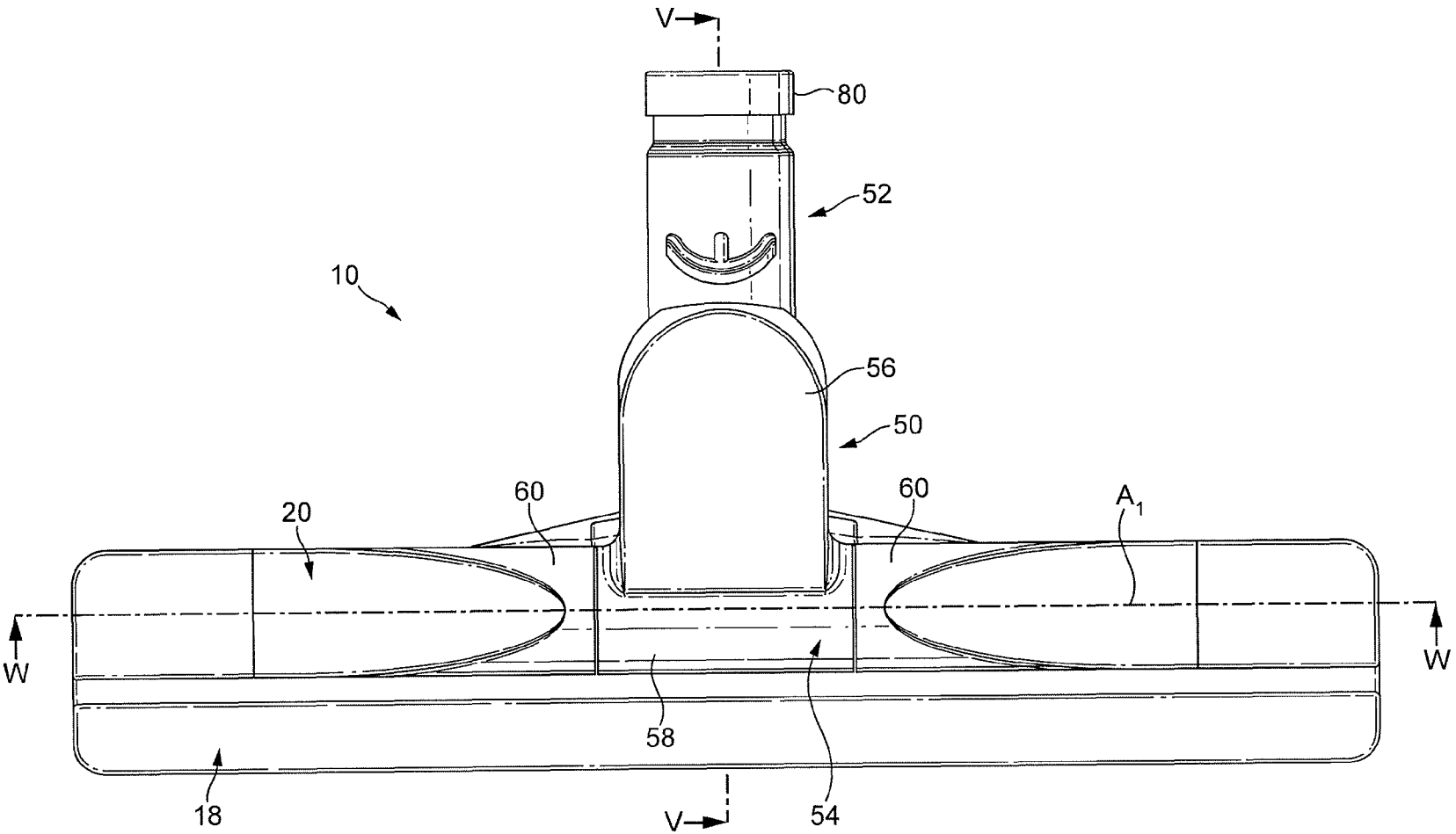
FIG. 3 is a top view of the floor tool as positioned in FIG. 1.
Figure 4:
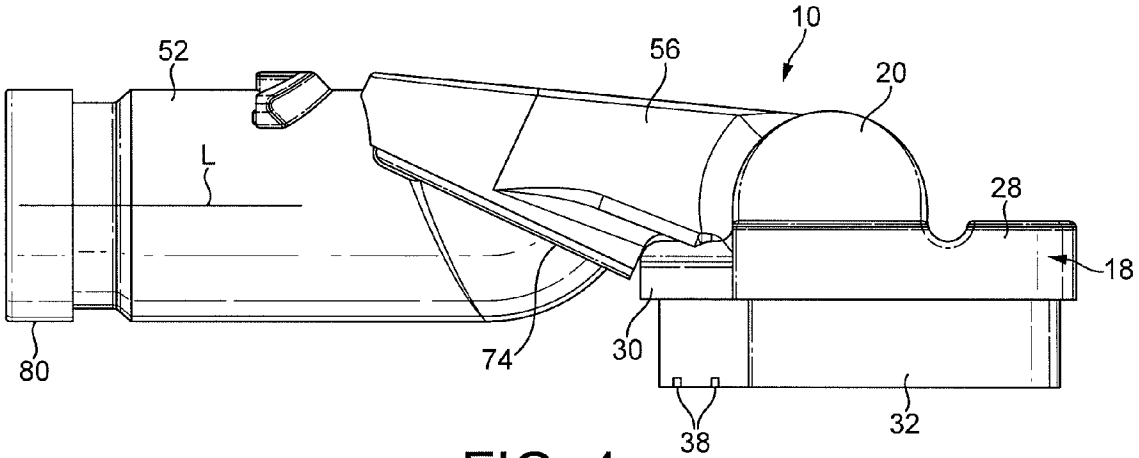
FIG. 4 is a side view of the floor tool as positioned in FIG. 1.

With reference first to FIGS. 1 to 5, a floor tool 10 comprises a main body 12 and a conduit 14 connected to the main body 12. The main body 12 comprises an elongate casing 16 comprising a lower section 18 and an upper section 20 located towards the rear of the main body 12. The lower section 18 comprises a first, front suction channel 22 and a second, rear suction channel 24 located adjacent to, and in the same plane as, the front suction channel 22. In use, both suction channels 22, 24 face a floor surface to be cleaned. Each of the suction channels 22, 24 extends between opposite side edges 26, 28 of the casing 16. As illustrated most clearly in FIG. 2, the rear suction channel 24 comprises an enlarged central portion 30 extending rearwardly away from the front suction channel 22 in the shape of a chevron to enhance stability as the floor tool 10 is maneuvered over the floor surface.

The main body 12 comprises flexible floor engaging members located about the suction channels 22, 24, and between the suction channels 22, 24. In this embodiment, the floor engaging members comprises a first set of bristles 32 that is arranged in the form of a substantially continuous skirt about the suction channels 22, 24, and a second set of bristles 34 that is arranged in a substantially continuous linear row between the suction channels 22, 24. Alternatively, one or both of the sets of bristles 32, 34 may be replaced by at least one strip of flexible material. Each set of bristles 32, 34, is retained within a respective groove formed in the casing 16 of the main body 12. The first set of bristles 32 comprises a series of relatively large castellations 36 in the front section of these bristles 32, lying adjacent the front edge of the front suction channel 22, to admit relatively large debris into the front suction channel 22, for example, during a forward stroke of the floor tool 10. The first set of bristles 32 also comprises a series of relatively small castellations 38 in the rear section of these bristles 32, lying adjacent the rear edge of the rear suction channel 24, to admit relatively small debris into the rear suction channel 24, for example, during a reverse stroke of the floor tool 10.

Intermediate channels 40 are located between the front suction channel 22 and the rear suction channel 24 to provide fluid communication between the suction channels 22, 24. The main body 12 comprises two intermediate channels 40 extending transversely between the suction channels 22, 24, with each intermediate channel 40 being located adjacent a respective side edge 26, 28 of the casing 16. In this embodiment, the row of bristles 34 does not extend fully between the side sections of the first set of bristles 32 so that each intermediate channel 40 is defined by a gap located between the first set of bristles 32 and a respective end of the row of bristles 34. Alternatively, the second set of bristles 34 may extend fully between the side sections of the first set of bristles 32, and at least one intermediate channel may be formed in the casing 16 of the main body 12 to convey fluid between the suction channels 22, 24.

The conduit 14 comprises a front section 50 and a rear section 52. The front section 50 is pivotably connected to the main body 12 for movement relative thereto about a first axis $A_1$, indicated in FIGS. 3 and 6. The front section 50 comprises a head 54 pivotably connected to the main body 12, and a neck 56 extending from the head 54 to the rear section 52 of the conduit 14.

The head 54 is positioned within a recess located centrally in the upper section 20 of the casing 16. The head 54 has a longitudinal axis which is substantially co-linear with the first axis $A_1$, and is connected to the upper section 20 of the casing 16 so that the head 54 is free to rotate about its longitudinal axis. The head 54 has a substantially cylindrical outer surface 58 which is open at each end. The upper section 20 of the casing 16 is shaped so that each portion 60 of the upper section 20 that adjoins a respective end of the head 54 is substantially flush with the outer surface 58 of the head 54. Consequently, each portion 60 of the upper section 20 of the casing 16 has a substantially semi-cylindrical outer surface.

Figure 7:
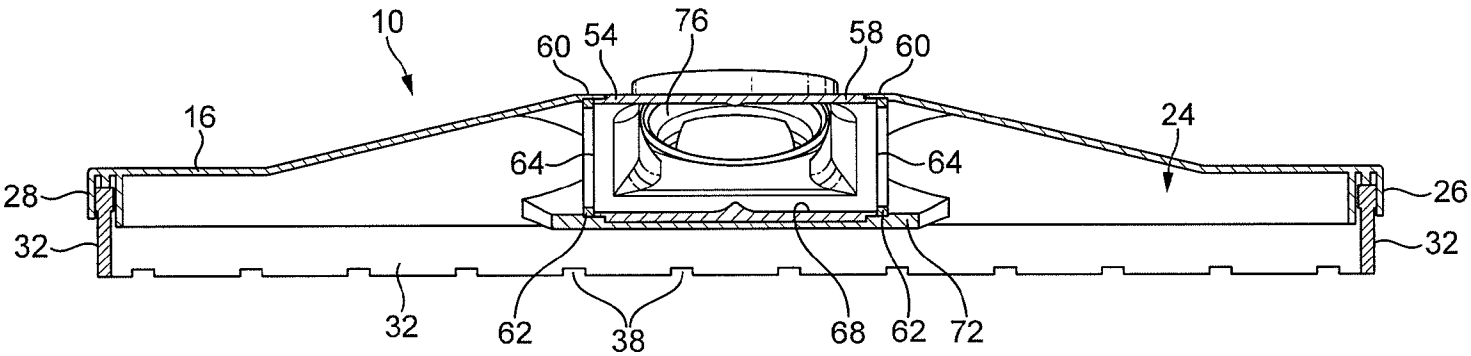
FIG. 7 is a front sectional view along line W-W in FIG. 3.
Figure 8:
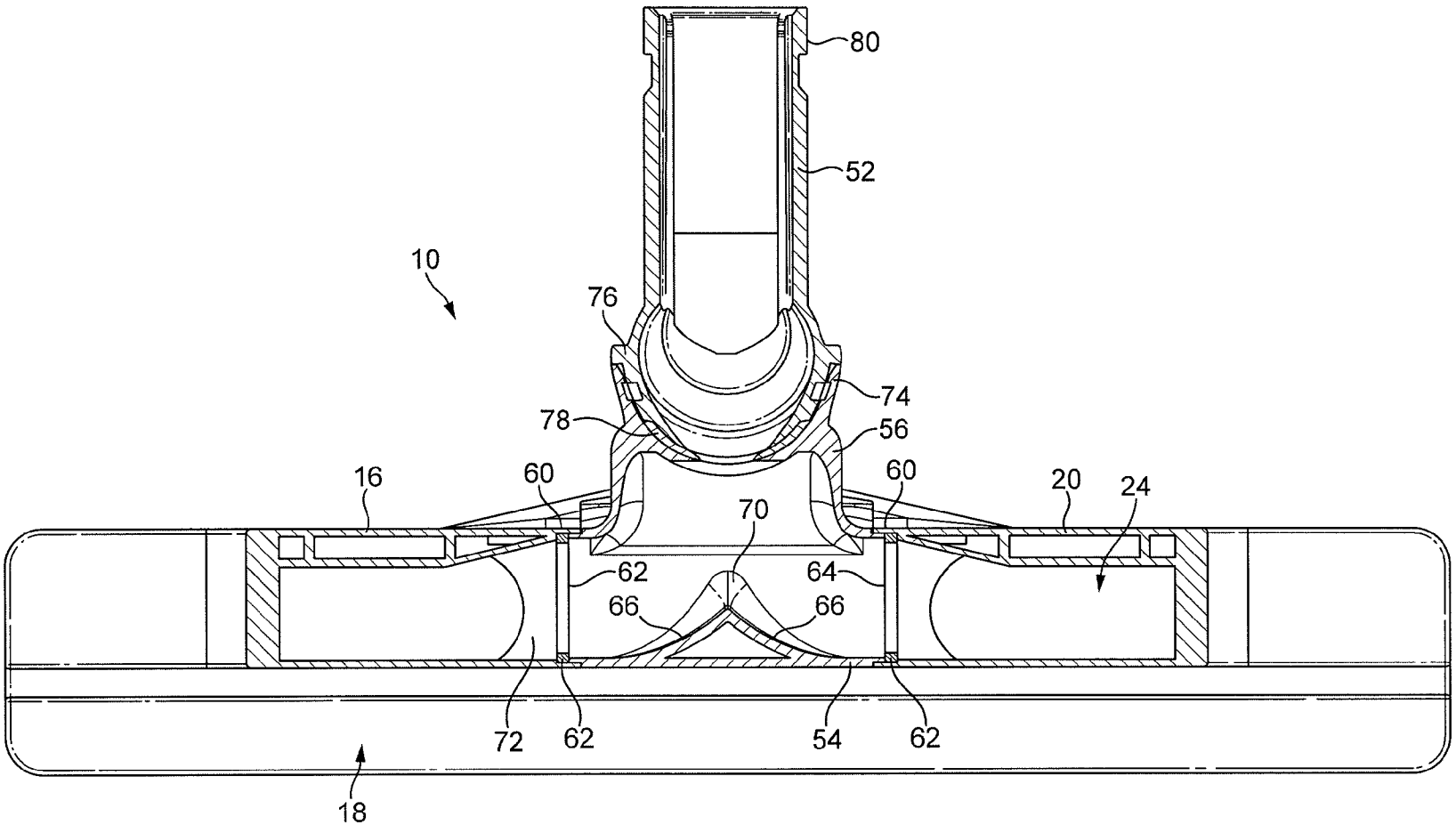
FIG. 8 is a top sectional view along line X-X in FIG. 5.

With particular reference to FIGS. 7 and 8, a sealing member 62 is provided between each end of the head 54 and its adjoining portion 60 of the upper section 20 of the casing 16 to form a substantially air-tight seal therebetween. Each end of the head 54 provides a respective port 64 through which fluid enters the conduit 14 from the main body 12. Each port 64 is thus substantially circular, and is substantially orthogonal to the longitudinal axis of the head 54, and therefore the first axis $A_1$, which passes centrally through each port 64. As a result, in use fluid passes into the head 54 through the ports 64 is opposing directions.

The neck 56 is connected to the head 54 substantially midway between the ports 64, and in this embodiment is integral with the head 54. The neck 56 extends away from the head 54 in a direction which is substantially orthogonal to the longitudinal axis of the head 54. Consequently, as fluid passes through the head 54 from one of the ports 64 and into the neck, the fluid changes direction by around 90°. To reduce turbulence within the head 54, the head 54 comprises two guide surfaces 66, each for guiding fluid entering the head 54 through a respective port 64 towards the neck 56. The guide surfaces 66 are preferably integral with the inner surface 68 of the head 54, and arranged so that each guide surface 66 curves away from the inner wall 68 towards the neck 56 to meet the other guide surface 66 at an apex 70 extending across the bore of the head 54.

The bottom of the recess within the upper section 20 of the casing 16 is delimited by a curved support surface 72 for supporting the head 54 of the front section 50 of the conduit 14. The support surface 72 is located centrally within the rear suction channel 24, and extends between the front and rear edges of the rear suction channel 24. The support surface 72 preferably has a radius of curvature which is substantially the same as that of the outer surface 58 of the head 54. In addition to supporting the head 54, the support surface 72 also serves to guide fluid into the head 54 from the rear suction channel 24, and to support part of the lower surface of the neck 56 of the front section 50 of the conduit 14 when the front section 50 is in its fully lowered position as illustrated in FIGS. 1 to 8.

Returning to FIG. 6, the rear section 52 of the conduit 14 is connected to the neck 56 of the front section 50 of the conduit 14 for pivotal movement relative thereto about a second axis $A_2$ angled to the first axis $A_1$. In this embodiment the second axis $A_2$ is orthogonal to the first axis $A_1$, and is inclined to the longitudinal axis L of the rear section 52, illustrated in FIG. 4, in this embodiment by an angle of around 65°.

Figure 6:
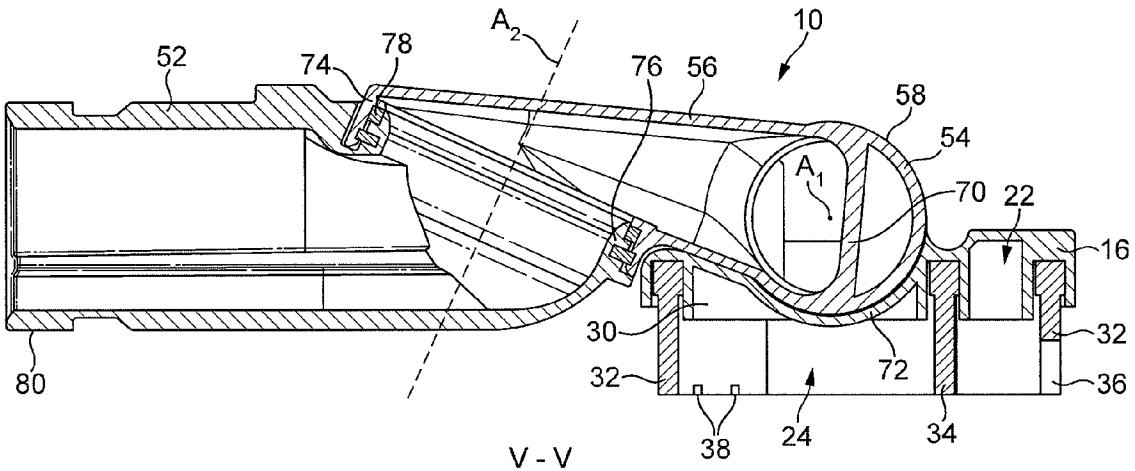
FIG. 6 is a side sectional view along line V-V in FIG. 3.
Figure 5:
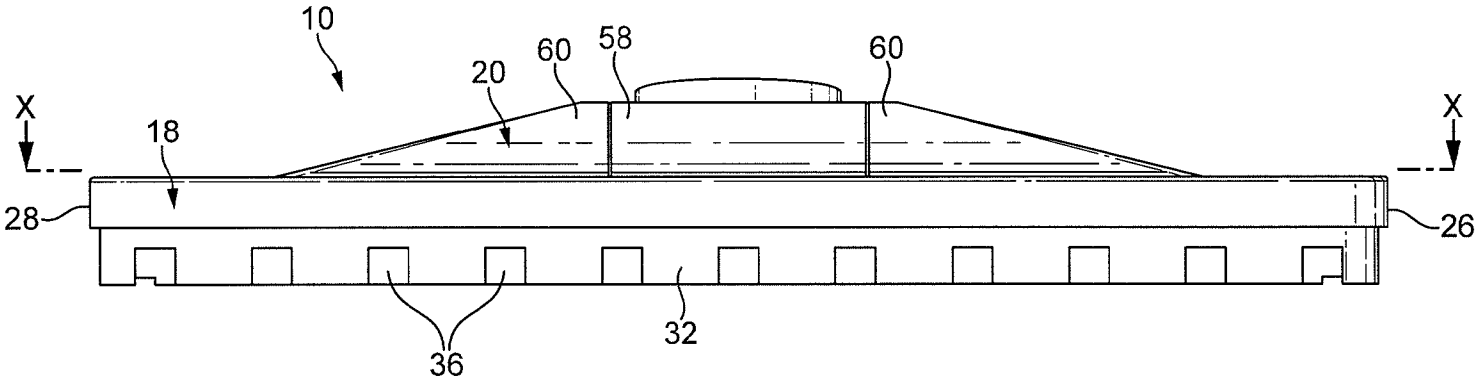
FIG. 5 is a front view of the floor tool as positioned in FIG. 1.

The connection between the front section 50 and the rear section 52 of the conduit 14 is effected by connecting a fluid outlet 74 of the neck 56 of the front section 50 of the conduit 14 to a fluid inlet 76 of the rear section 52 of the conduit 14. The fluid outlet 74 of the neck 56 is substantially cylindrical, and is angled downwardly (as illustrated in FIG. 6) towards a floor surface to be cleaned. The fluid inlet 76 of the rear section 52 is also substantially cylindrical and is angled upwardly (as illustrated in FIG. 6) away from the floor surface so that when the fluid inlet 76 is received within the fluid outlet 74, the longitudinal axis L of the rear section 52 of the conduit 14 is substantially horizontal when the front section 50 of the conduit 14 is in its fully lowered position. This enables the floor tool 10 to have a relatively low profile when in its fully lowered position. The fluid inlet 76 of the rear section 52 is received within the fluid outlet 74 of the neck 56 so that the longitudinal axes of the fluid outlet 74 and the fluid inlet 76 are substantially co-linear with the second axis $A_2$, and the fluid inlet 76 is rotatable relative to the fluid outlet 74 about the second axis $A_2$. A sealing member 78 is located between the inner surface of the fluid inlet 74 and the outer surface of the fluid outlet 76 to inhibit fluid loss from therebetween.

The rear section 52 of the conduit 14 comprises a fluid outlet 80 which is connectable to a wand, hose or other such duct of a cleaning appliance which comprises dirt and dust separating apparatus and a motor-driven fan unit for drawing dirt-bearing fluid into the main body 12 of the floor tool 10.

In use, with the floor tool 10 located on a floor surface so that both the first set of bristles 32 and the second set of bristles 34 engage the floor surface, operation of the fan unit generates two different pressure regions within the main body 12. Due to the relatively tight seal formed around the rear suction channel 24 by the two sets of bristles 32, 34, a relatively high vacuum can be established in the rear suction channel 24. This can optimise the entrainment of dust and debris located within crevices in the floor surface within a fluid flow drawn into the rear suction channel 24 between the two sets of bristles 32, 34. A relatively small amount of this vacuum is sacrificed by the provision of (i) the relatively small castellations 38 in the first set of bristles 32, to enable dust and relatively small debris located on the floor surface to be entrained within a fluid flow drawn though the relatively small castellations 38 into the rear suction channel 24, and (ii) the intermediate channels 40 between the first set of bristles 32 and the second set of bristles 34.

The provision of the relatively small castellations 38 can reduce the amount of debris that builds up along the rear edge of the main body 12 as the floor tool 10 is maneuvered in a reverse direction over the floor surface. On the other hand, the provision of these intermediate channels 40 establishes a relatively low vacuum in the front suction channel 22 to enable dust and relatively large debris located on the floor surface to be entrained within a fluid flow drawn into the front suction channel 22 through the relatively large castellations 36. This first, dirt-bearing fluid flow is conveyed from the front suction channel 22 through the intermediate channels 40 to the rear suction channel 24, where it merges with fluid drawn directly into the rear suction channel 24. The merged fluid flow passes into the upper section 20 of the casing 16 and through the ports 64 into the head 54 of the front section 50 of the conduit 14. The guide surfaces 66 within the head 54 guide the fluid flow into the neck 56. From the neck 56, the fluid flow passes into the rear section 52 of the conduit 14, and into a wand (not shown) connected to the fluid outlet 80 of the rear section 52.

As the floor tool 10 is maneuvered over the floor surface, the flexibility of the bristles 32, 34 can enable the contact between the bristles 32, 34 and the floor surface, and thus the two different pressure regions within the main body 12, to be maintained over a wide range of orientations of the wand relative to the main body 12. FIGS. 1 to 8 illustrates the conduit 14 in a fully lowered position, in which the upper extremity of the floor tool 10 is only slightly higher than the uppermost extremity of the head 54 of the front section 50 of the conduit 14. This can enable the floor tool 10 to be maneuvered beneath, for example, items of furniture located on the floor surface while maintaining contact between the bristles 32, 34 and the floor surface. During use, the conduit 14 can be raised from this fully lowered position, for example to facilitate maneuvering of the floor tool 10 over an open floor surface, by raising the wand (not shown) connected to the fluid outlet 80, thus causing the head 54 of the front section 50 of the conduit 14 to pivot about the first axis $A_1$.

Figure 9:
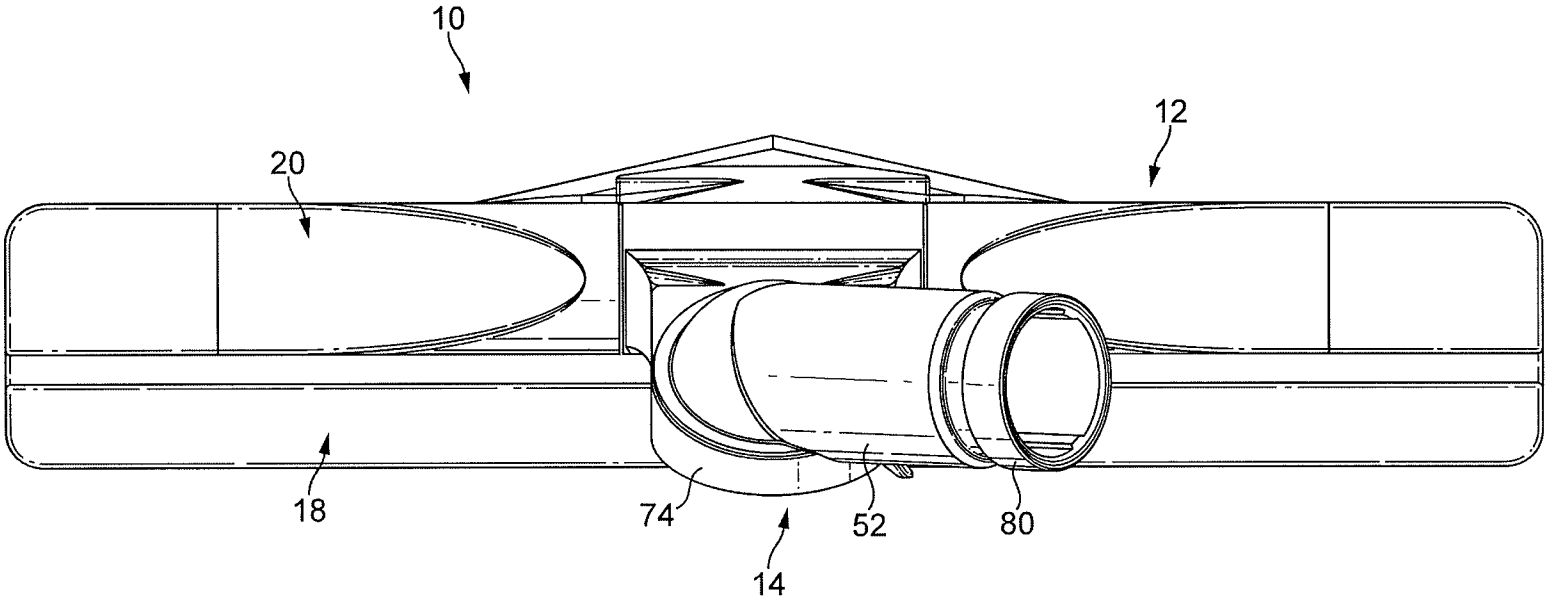
FIG. 9 is a top view of the floor tool of FIG. 1, with the conduit in a raised position.
Figure 10:
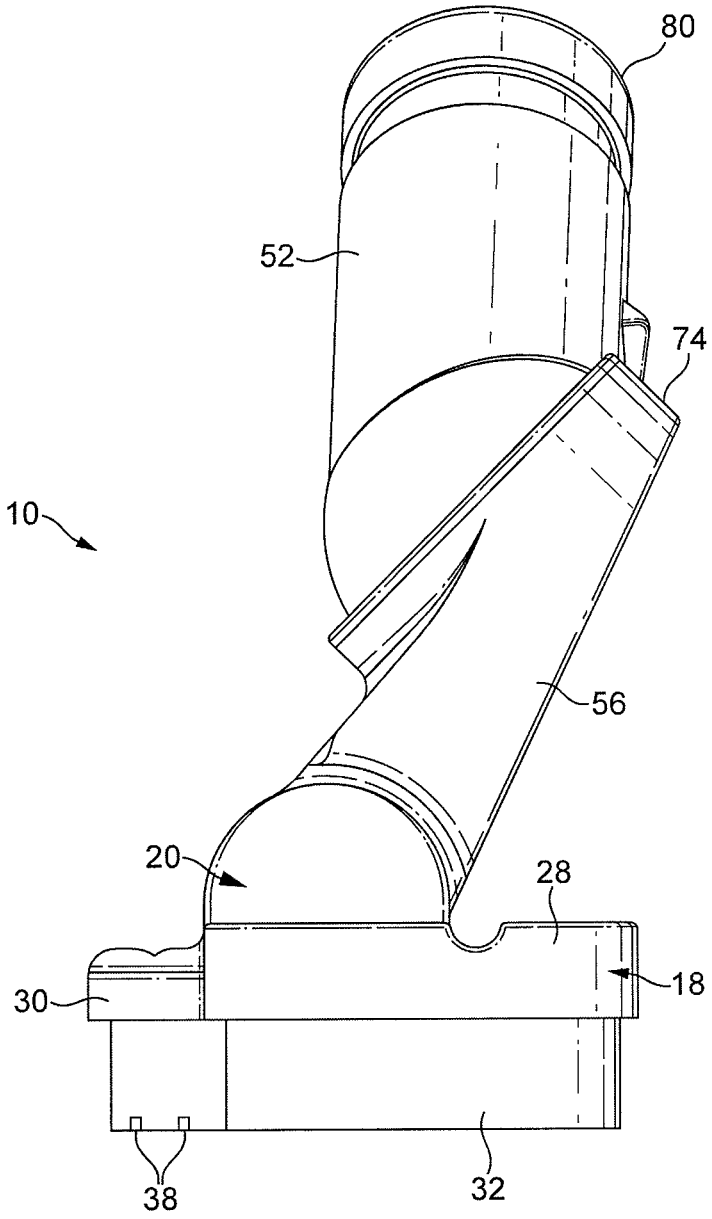
FIG. 10 is a side view of the floor tool as positioned in FIG. 9.
Figure 11:
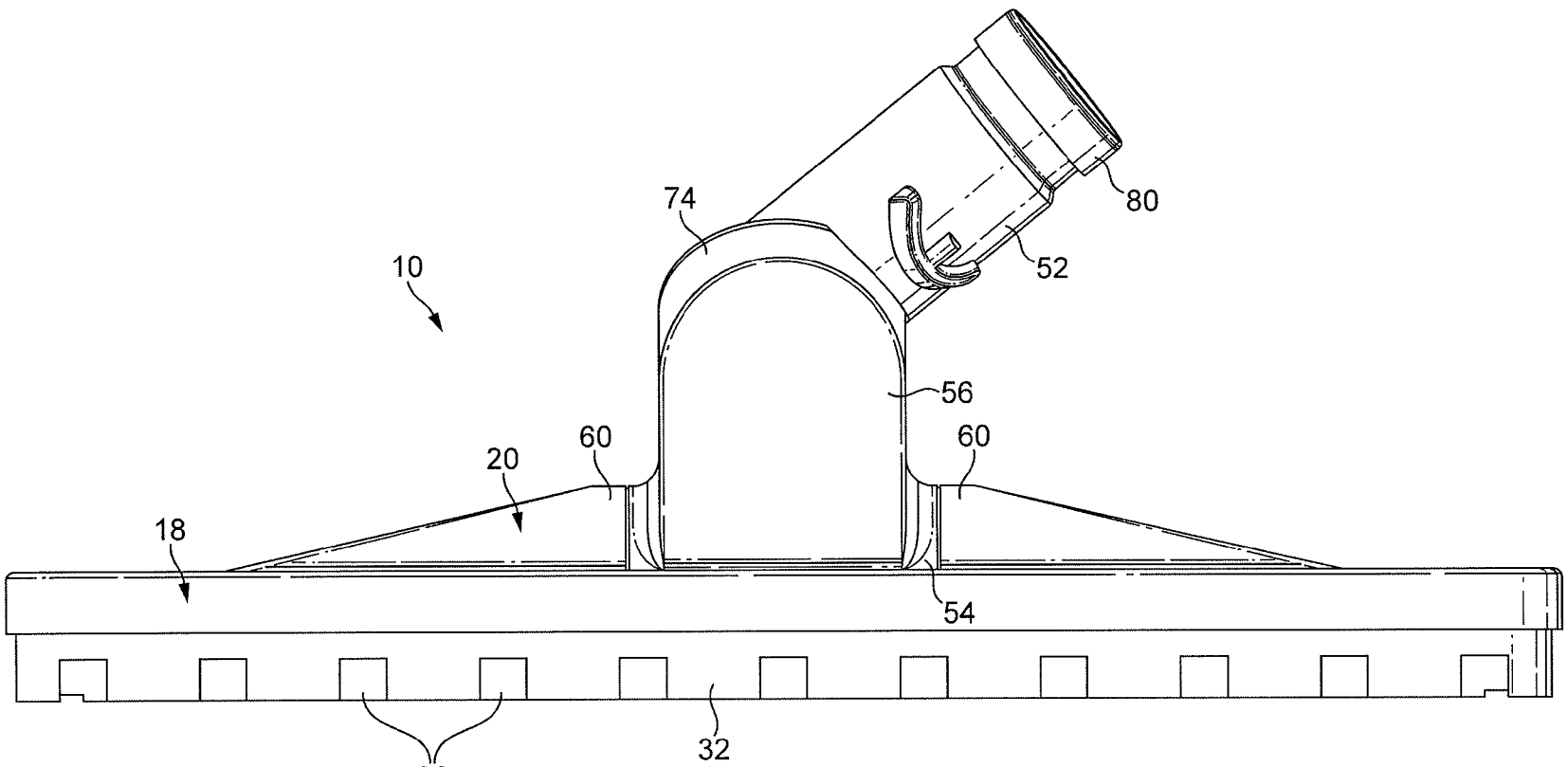
FIG. 11 is a front view of the floor tool as positioned in FIG. 9.

By way of example, the front section 50 of the conduit 14 can be raised from the fully lowered position shown in FIGS. 1 to 8 to a raised position, shown in FIGS. 9 to 11, by pivoting the front section 50 of the conduit 14 relative to the main body 12 about an angle of around 110°. Simultaneously with, or separately from, the pivoting of the front section 50 of the conduit 14 relative to the main body 12, the rear section 52 of the conduit 14 may be pivoted relative to the front section 50 of the conduit 14 by turning the wand relative to the main body 12, which causes the fluid inlet 76 to rotate relative to the fluid outlet 74. For example, in the raised position shown in FIGS. 9 to 11 the rear section 52 of the conduit 14 has been pivoted relative to the front section 50 of the conduit 14 by around 40°. In this raised position, a wand connected to the fluid outlet 80, may be substantially parallel to the main body 12 of the floor tool, enable the floor tool 10 to be pushed and pulled sideways by the user, for example into a relatively narrow gap between items of furniture or between an item of furniture and a wall, while maintaining the bristles 32, 34 in contact with the floor surface.

The invention is not limited to the detailed description given above. Variations will be apparent to the person skilled in the art.

The invention claimed is:

1. A tool for a surface treating appliance, comprising a main body connected to a conduit, the main body comprising:

a first suction channel for receiving a first dirt-bearing fluid flow; and a second suction channel for receiving the first dirt-bearing fluid flow from the first suction channel and a second dirt-bearing fluid flow, and for conveying the dirt-bearing fluid flows to the conduit;

wherein the first suction channel and the second suction channel are at least partially defined by flexible surface engaging members, the flexible surface engaging members comprising at least one first flexible surface engaging member located about the suction channels and at least one second flexible surface engaging member located between the suction channels wherein the first suction channel is located towards the front of the main body, and the second suction channel is located towards the rear of the main body, and wherein the second suction channel comprises an enlarged central portion extending rearwardly away from the first suction channel.

2. The tool of claim 1, wherein the second suction channel is located adjacent an outlet from the main body.

3. The tool of claim 2, wherein the second suction channel is located between the outlet and the first suction channel.

4. The tool of claim 1, wherein the at least one first flexible surface engaging member comprises at least one of a plurality of bristles, a plurality of filaments and at least one strip of flexible material.

5. The tool of claim 1, wherein the at least one second flexible surface engaging member comprises at least one of a plurality of bristles, a plurality of filaments and at least one strip of flexible material.

6. The tool of claim 1, wherein a first series of castellations is provided in a portion of the at least one first flexible surface engaging member adjacent the first suction channel, and a second series of castellations is provided in a portion of at least one first flexible surface engaging member adjacent the second suction channel.

7. The tool of claim 6, wherein the first series of castellations is larger than the second series of castellations.

8. The tool of claim 1, comprising at least one intermediate channel located between the first suction channel and the second suction channel for conveying the first dirt-bearing fluid flow therebetween.

9. The tool of claim 8, wherein the at least one intermediate channel extends transversely to the suction channels.

10. The tool of claim 8, wherein the at least one intermediate channel comprises a first intermediate channel and a second intermediate channel located at or towards opposite sides of the main body.

11. The tool of claim 8, wherein the at least one intermediate channel is defined by at least one interruption within the flexible surface engaging members.

12. The tool of claim 1, wherein the conduit comprises a head comprising at least one port for receiving the first and second dirt-bearing fluid flows from the second suction channel.

13. The tool of claim 12, wherein the main body comprises a support for supporting the head of the conduit above part of the second suction cavity.

14. The tool of claim 12, wherein the at least one port comprises a first port and a second port located opposite to the first port each for receiving fluid from respective side of the second suction channel.

15. The tool of claim 14, wherein the first port and the second port are substantially concentric.

16. The tool of claim 14, wherein the head has a longitudinal axis, and the face of each of the ports is substantially orthogonal to the longitudinal axis of the head and an axis which passes centrally through each port.

17. The tool of claim 14 wherein the conduit comprises a neck connected to the head substantially midway between the ports.

18. The tool of claim 17, wherein the head comprises at least one guide surface for directing fluid towards the neck.

19. The tool of claim 1, wherein the conduit comprises a front section pivotably connected to the main body for movement relative thereto about a first axis and a rear section pivotably connected to the front section for movement relative thereto about a second axis.

20. A tool for a surface treating appliance, comprising a main body connected to a conduit, the main body comprising:

a first suction channel for receiving a first dirt-bearing fluid flow; and a second suction channel for receiving the first dirt-bearing fluid flow from the first suction channel and a second dirt-bearing fluid flow, and for conveying the dirt-bearing fluid flows to the conduit;

wherein the first suction channel and the second suction channel are at least partially defined by flexible surface engaging members, the flexible surface engaging members comprising at least one first flexible surface engaging member located about the suction channels and at least one second flexible surface engaging member located between the suction channels, wherein a first series of castellations is provided in a portion of the at least one first flexible surface engaging member adjacent the first suction channel, and a second series of castellations is provided in a portion of at least one first flexible surface engaging member adjacent the second suction channel, and wherein the first series of castellations is larger than the second series of castellations.

21. A tool for a surface treating appliance, comprising a main body connected to a conduit, the main body comprising:

a first suction channel for receiving a first dirt-bearing fluid flow; and a second suction channel for receiving the first dirt-bearing fluid flow from the first suction channel and a second dirt-bearing fluid flow, and for conveying the dirt-bearing fluid flows to the conduit;

wherein the first suction channel and the second suction channel are at least partially defined by flexible surface engaging members, the flexible surface engaging members comprising at least one first flexible surface engaging member located about the suction channels and at least one second flexible surface engaging member located between the suction channels, wherein the conduit comprises a head comprising at least one port for receiving the first and second dirt-bearing fluid flows from the second suction channel, wherein the at least one port comprises a first port and a second port located opposite to the first port each for receiving fluid from respective side of the second suction channel, and wherein the head has a longitudinal axis, and the face of each of the ports is substantially orthogonal to the longitudinal axis of the head and a first axis which passes centrally through each port.

* * * * *